US006352041B1

(12) United States Patent
Lin et al.

(10) Patent No.: US 6,352,041 B1
(45) Date of Patent: Mar. 5, 2002

(54) METHOD FOR PREVENTING CORROSION OF A FURNACE

(75) Inventors: Ming-Chin Lin; Robin Hsueh, both of Hsinchu (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/789,355

(22) Filed: Feb. 20, 2001

(30) Foreign Application Priority Data

Feb. 13, 2001 (TW) ..... 90103094 A

(51) Int. Cl.[7] ..... F23B 7/00
(52) U.S. Cl. ..... 110/341; 110/343; 110/295
(58) Field of Search ..... 110/343, 341, 110/336, 326, 295; 431/3; 432/2; 106/14.05; 118/715, 719, 724, 725, 728, 729; 427/255.19, 255.21, 255.4

(56) References Cited

U.S. PATENT DOCUMENTS 2,446,222 A * 9/1948 Fletcher et al. ..... 266/19
4,252,561 A * 2/1981 Hirano et al. ..... 75/126 C
4,487,744 A * 12/1984 Debol et al. ..... 420/584
5,226,968 A * 7/1993 Ohmi et al. ..... 118/720
5,407,705 A * 4/1995 Vakil ..... 427/255
5,805,973 A * 9/1998 Coffinberry et al. ..... 428/551
5,964,103 A * 10/1999 Mabuchi et al. ..... 62/476
6,010,750 A * 1/2000 Gole et al. ..... 427/250
6,139,909 A * 10/2000 Hagewiesche ..... 427/142
2001/0001965 A1 * 5/2001 Miyoshi et al. ..... 148/264

FOREIGN PATENT DOCUMENTS

JP 10195629 * 7/1998 ..... C23C/8/12
JP 10212564 * 9/1998 ..... C23C/8/14

* cited by examiner

*Primary Examiner*—Denise L. Esquivel
*Assistant Examiner*—K. B. Rinehart
(74) *Attorney, Agent, or Firm*—Thomas, Kayden, Horstemeyer & Risley

(57) ABSTRACT

A method for preventing corrosion of a furnace by a corrosive gas. The material for the bottom tray in the furnace is made of anti-corrosion alloy such as molybdenum and chromium. The furnace also has an oxygen-containing gas pipe for charging the oxygen-containing gas. The oxygen-containing gas is reacted in a high temperature to form a purple oxide alloy film on the surface of the alloy tray.

16 Claims, 1 Drawing Sheet

METHOD FOR PREVENTING CORROSION OF A FURNACE

This application claims the priority benefit of Taiwan application serial no. 90103094, filed Feb. 13, 2001.

BACKGROUND OF THE INVENTION

1. Field of the Invention

The present invention relates to a method for preventing corrosion of a furnace. More specifically, the present invention relates to a method for preventing corrosion of a furnace by a corrosive gas such as gaseous hydrogen chloride.

2. Description of the Related Art

When thermal oxidation is carried out in a conventional furnace, acidic side products, such as hydrogen chloride, are always generated when silicon dioxide is formed. Since the bottom of the furnace is made of metal iron, the acidic side products contact with the bottom of the furnace when the acidic side products exit from the furnace as a stream. The acidic side products react with the metal iron of the furnace bottom as follows:

$$2Fe+6HCl \rightarrow 2FeCl_3+3H_2$$

When iron is exposed in an acidic environment, especially one containing hydrogen chloride in a high temperature, $FeCl_3$ is often generated on the surface of iron causing damage on the bottom. $FeCl_3$ restricts the formation of a thermal oxide layer in a subsequent step and the formation of an oxide layer obtained by chemical vapor deposition.

Moreover, when the bottom of the metal is corroded, a new bottom is required to replace the corroded one. If corrosion occurs, the bottom has a shorter service life. Furthermore, not only the bottom is subject to corrosion, but also any part in the furnace made of metal can be corroded.

SUMMARY OF THE INVENTION

In one aspect of the present invention, an anti-corrosion furnace in which a dense be oxide alloy film is formed on the surface of the bottom tray to prevent corrosion of the bottom tray by an acidic substance is provided to overcome the problems in the prior art.

In another aspect of the present invention, a method for preventing corrosion of a furnace by a corrosive gas is provided. In the present invention, the material for the bottom tray of the furnace is made of an anti-corrosion alloy such as molybdenum and chromium. An oxygen-containing gas pipe is also provided in the furnace for charging the oxygen-containing gas. The oxygen-containing gas is reacted in a high temperature to form a purple oxide alloy film on the surface of the alloy tray.

The oxide alloy film of the present invention can prevent the reaction between acidic substances and the alloy tray, which would not adversely affect the quality of the oxide formed in a subsequent step.

BRIEF DESCRIPTION OF THE DRAWINGS

It is to be understood that both the foregoing general description and the following detailed description are exemplary, and are intended to provide further explanation of the invention as claimed.

The accompanying drawings are included to provide a further understanding of the invention, and are incorporated in and constitute a part of this specification. The drawings illustrate embodiments of the invention and, together with the description, serve to explain the principle of the invention. In the drawings.

DESCRIPTION OF THE PREFERRED EMBODIMENT

Figure 1:
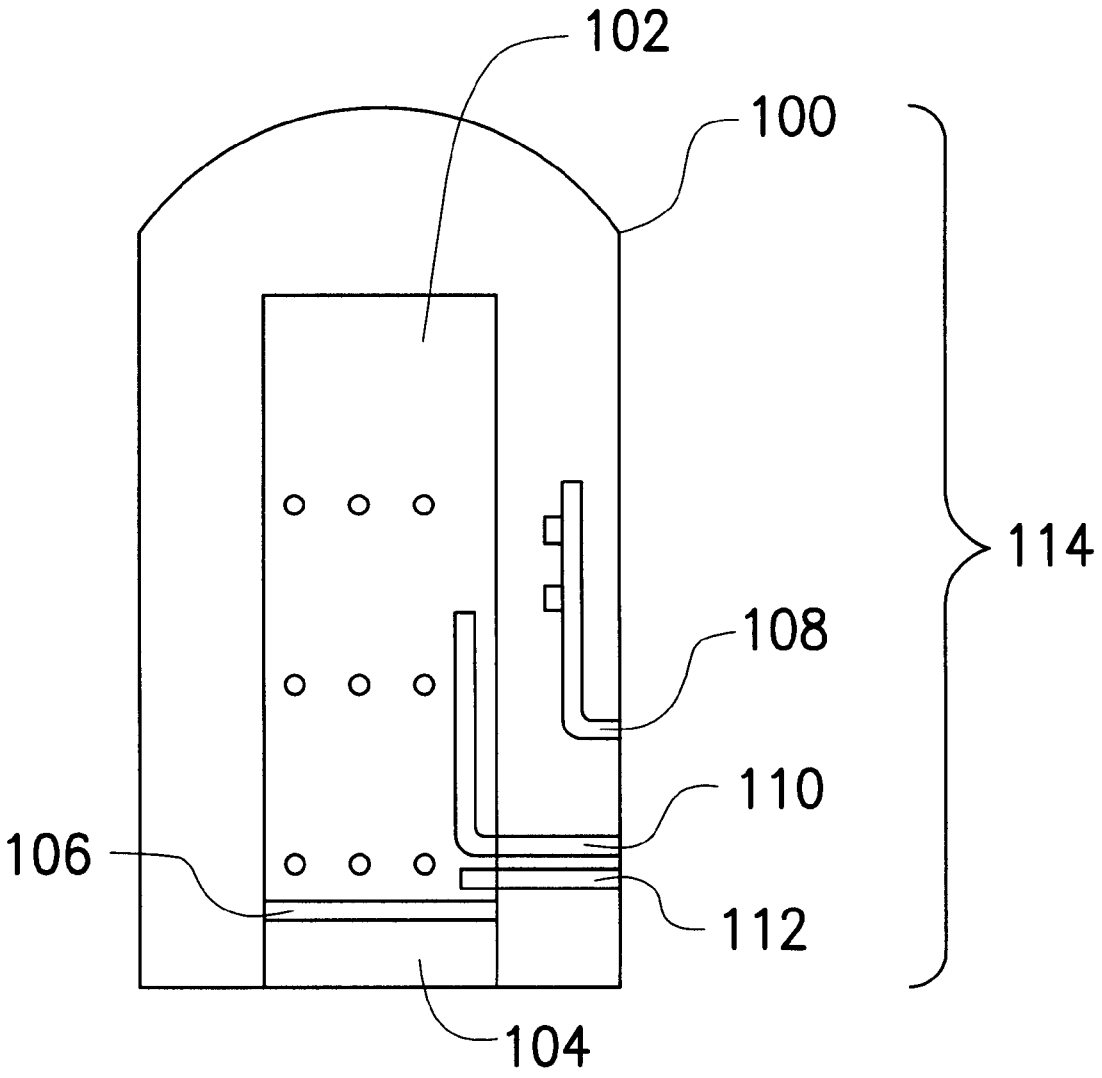
FIG. 1 is a side view of a furnace that can avoid corrosion by a corrosive gas according to one preferred embodiment of the present invention.

Reference will now be made in detail to the present preferred embodiments of the invention, examples of which are illustrated in the accompanying drawings. Whenever possible, the same reference numbers are used in the drawings and the description to refer to the same or like parts.

FIG. 1 is a side view of a furnace that can avoid corrosion by a corrosive gas according to one preferred embodiment of the present invention. With reference to FIG. 1, an anti-corrosion furnace 114 is first provided. The anti-corrosion furnace 114 consists of an outer furnace 100, an inner furnace 102, an alloy tray 104, an oxide alloy film 106, an oxygen-containing gas pipe 112 and gas pipes 108 and 110. The bottom of the anti-corrosion furnace 114 is provided with a heater (not shown) to supply heat to the furnace 114. The anti-corrosion pipe 114 can be a vacuum furnace, a low-pressure chemical vapor deposition reactor or a thermal oxidation furnace, for example.

The inner furnace 102, the oxide alloy film 106 and the alloy tray 104 are included inside the outer furnace 100. The outer furnace 100 can be a vacuum furnace in the form of a hollow column. The inner furnace 102 that is a hollow column shaped furnace is located above the alloy tray 104. A plurality of holes can be provided on the furnace wall to allow ventilation of the inner furnace 102. The inner furnace 102 has the same sectional shape as the alloy tray 104.

The alloy tray 104 is located at the bottom of the anti-corrosion furnace 114 and above the heater (not shown). The alloy bottom tray 104 can be made of a material selected from a group consisting of molybdenum, chromium or other anti-corrosion metals. The oxide alloy film 106 is located on the surface of the alloy tray 104. The oxide alloy film 106 can be formed by charging the oxygen-containing gas into the furnace 114 through one of the oxygen-containing gas pipe 112 or gas pipes 108, 110 and carrying out a reaction of the oxygen-containing gas under a high temperature. When the surface of the alloy tray 104 turns purple, it means that the oxide alloy film 106 is formed on the surface of the alloy tray 104. In one embodiment of the present invention, air is charged in the furnace through a gas pipe and is reacted in a temperature of about 800° C. for about 24 hours. An oxide alloy film is formed once the surface of the alloy tray 104 turns purple.

The oxide alloy film 106 does not react with acidic substances. Therefore, the acidic substance generated during the process does not react with the alloy tray 104, so the oxide is not affected during the subsequent processes.

One end of the gas pipe 108 is located between the outer furnace 100 and the inner furnace 102. One end of the gas pipe 110 is situated around the inner wall of the inner furnace 102. The gas pipes 108 and 110 are used for the reactive gases to enter into or exit from the furnace 114. Furthermore, the gas pipes 108 and 110 are passed through the outer furnace 100 and connected to an additional reactive gas source (not shown).

The oxygen-containing gas pipe 112 is a gas pipe additionally provided for the original furnace. One end of the oxygen-containing gas pipe 112 is located near the oxide alloy tray 104 inside the inner furnace 102. The oxygen-containing gas pipe 112 passes through the outer furnace 100 to connect to the oxygen-containing gas source (not shown). An oxygen-containing gas is supplied to the furnace through the pipe 112 for formation of the oxide alloy film 106 by a reaction with the surface of the alloy tray 104.

Furthermore, the alloy and the oxide alloy film provided by the present invention is not limited to use for the alloy tray as recited in the specification. They can be used in other parts made of metal in the furnace to prevent corrosion.

It will be apparent to those skilled in the art that various modifications and variations can be made to the structure of the present invention without departing from the scope or spirit of the invention. In view of the forgoing, it is intended that the present invention cover modifications and variations of this invention provided they fall within the scope of the following claims and their equivalents.

What is claimed is:

1. A method for preventing corrosion of a furnace by a corrosive gas, comprising:

providing a furnace having a plurality of gas pipes, and an alloy tray formed at a bottom portion of the furnace;

charging an oxygen-containing gas into the furnace; and reacting the oxygen-containing gas at a surface of the alloy tray in order to form an oxide alloy film thereon.

2. The method of claim 1, wherein the alloy tray is made of molybdenum.

3. The method of claim 1, wherein the alloy tray is made of chromium.

4. The method of claim 1, wherein the oxygen-containing gas is charged into the furnace through the gas pipe inside the furnace.

5. The method of claim 1, further comprising the step of providing an oxygen-containing gas pipe in the furnace for charging the oxygen-containing gas, such that the oxygen-containing gas is charged in the furnace through the oxygen-containing gas pipe.

6. The method of claim 1, wherein the oxygen-containing gas is air.

7. The method of claim 6, wherein the oxide alloy film is formed by reacting the air in a high temperature such that a purple film is formed.

8. An anti-corrosion furnace, comprising:

an outer furnace;

an inner furnace located inside the outer furnace; and an alloy tray located at a bottom portion of the inner furnace, the alloy tray having an oxide alloy film thereon, wherein the outer furnace or the inner furnace or both has a plurality of gas pipes.

9. The anti-corrosion furnace of claim 8, further comprising:

an oxygen-containing gas pipe which passes through the outer furnace and the inner furnace, one end of which is located around the alloy tray inside the inner furnace and another end of which is located outside of the outer furnace and connected to the oxygen-containing gas supply.

10. The anti-corrosion furnace of claim 8, wherein the alloy tray is made of molybdenum.

11. The anti-corrosion furnace of claim 8, wherein the alloy tray is made of chromium.

12. The anti-corrosion furnace of claim 8, wherein the oxide alloy film is purple.

13. The anti-corrosion furnace of claim 8, wherein the furnace is a vacuum furnace.

14. The anti-corrosion furnace of claim 8, wherein the furnace is a thermal oxidation furnace.

15. The anti-corrosion furnace of claim 8, wherein the furnace is a low-pressure chemical vapor deposition reactor.

16. The anti-corrosion furnace of claim 8, wherein the alloy tray is made of anti-corrosion metals.

* * * * *